US006684830B2

(12) United States Patent
Miyashita

(10) Patent No.: US 6,684,830 B2
(45) Date of Patent: Feb. 3, 2004

(54) VARIABLE VALVE TIMING ENGINE

(75) Inventor: Yukio Miyashita, Saitama (JP)

(73) Assignee: Honda Giken Kogyo Kabushiki Kaisha, Minato-ku (JP)

( * ) Notice: Subject to any disclaimer, the term of this patent is extended or adjusted under 35 U.S.C. 154(b) by 0 days.

(21) Appl. No.: 10/101,700

(22) Filed: Mar. 21, 2002

(65) Prior Publication Data

US 2002/0134333 A1 Sep. 26, 2002

(30) Foreign Application Priority Data

Mar. 23, 2001 (JP) ..... 2001-083945
Mar. 27, 2001 (JP) ..... 2001-090046

(51) Int. Cl.[7] ..... F01L 1/34
(52) U.S. Cl. ..... 123/90.15; 123/90.16; 123/90.17; 123/90.31
(58) Field of Search ..... 123/90.15, 90.16, 123/90.17, 90.31, 568.21, 568.16

(56) References Cited

U.S. PATENT DOCUMENTS 4,794,903 A * 1/1989 Suzuki ..... 123/571
5,060,604 A * 10/1991 Seki et al. ..... 123/90.16
5,140,961 A * 8/1992 Sawamoto et al. ..... 123/419
5,845,613 A * 12/1998 Yoshikawa ..... 123/90.15
6,076,502 A * 6/2000 Katashiba et al. ..... 123/435
6,330,870 B1 * 12/2001 Inoue et al. ..... 123/90.17

FOREIGN PATENT DOCUMENTS

JP 60150408 A * 8/1985 ..... F01L/1/34

OTHER PUBLICATIONS

US Patent Application Pub. No. US 2002/0139357 A1.*
Patent Abstracts of Japan, Publication No. 05–263745, dated Oct. 12, 1993.
Patent Abstracts of Japan, Publication No. 11–125126, dated May 11, 1999.

* cited by examiner

*Primary Examiner*—Thomas Denion
*Assistant Examiner*—Ching Chang
(74) *Attorney, Agent, or Firm*—Armstrong, Kratz, Quintos, Hanson & Brooks, LLP

(57) ABSTRACT

An EGR passage 8 that recirculates exhaust gases in an exhaust pipe 5 of an engine 1 to an intake system by negative intake-gas pressure is provided. An intake cam 24 that opens and closes an intake valve 6 is provided so that a phase angle of the intake cam 24 may be adjusted through a VTC 27 (phase angle adjustment means). The phase angle of the intake cam 24 is adjusted in accordance with increase or decrease of a flow rate of recirculation of exhaust gases, thus restricting occurrence of $NO_x$.

11 Claims, 9 Drawing Sheets

VARIABLE VALVE TIMING ENGINE

BACKGROUND OF THE INVENTION

This invention relates to a variable valve timing engine including an exhaust gas recirculation device (hereinafter referred to as "EGR device") that recirculates part of exhaust gases back to a combustion chamber to reduce $NO_x$ emissions.

A conventional EGR device, for example, as disclosed in Japanese Laid-Open Patent Application, Publication No. 11-125126, A, includes an exhaust gas recirculation passage (hereinafter referred to as "EGR passage") and an exhaust gas recirculation valve (hereinafter referred to as "EGR valve"). The EGR passage is provided to connect an intake passage and an exhaust passage with each other. The EGR valve is provided at a junction of an upstream end of the EGR passage and the exhaust passage to open and close the EGR passage. The EGR valve may open and close the EGR passage between a wide-open state and a tightly closed-off state inclusive to control a recirculation flow rate of exhaust gases flowing from the exhaust passage to the intake passage. The EGR valve opens, closes, or throttles based upon loads on the engine, engine speeds, temperature of cooling water, or the like, so as to recirculate exhaust gases at a controlled flow rate according to a varying driving state to the combustion chamber of the engine. A variable valve timing engine including a phase angle adjustment means that adjusts a phase angle between an exhaust cam for opening/closing an exhaust valve and an intake cam for opening/closing an intake valve is also known in the art.

Recirculation of part of exhaust gases through the EGR passage to the combustion chamber of the engine may advantageously restrict a steep increase in combustion speed and combustion heat, lowers combustion temperature, and thus reduces $NO_x$ emissions. Further, reduced pumping loss due to the recirculation may contribute to increased fuel efficiency.

However, as unburned fuel (hydrocarbon) in exhaust gases deposited on surfaces of the EGR passage and EGR valve gradually becomes carbonized with intense heat, the EGR passage or EGR valve is clogged with a growing blockage, which would disadvantageously interfere with recirculation of exhaust gases, producing unexpected extra emissions of $NO_x$. Moreover, exfoliation of deposited carbon caused for some reason would change the rate of flow passing through the EGR passage, and disadvantageously produce extra emissions of $NO_x$, as well. Further, change in overlap, or time during which the intake and exhaust valves are both open, through adjustment by the phase angle adjustment means would increase a flow rate of internal recirculation of the exhaust gases, and would make the EGR flow rate difficult to properly control according to the driving state, as the conventional EGR device includes no mechanism to control the flow rate of internal recirculation of the exhaust gases in accordance with the flow rate of recirculation of exhaust gases in the EGR passage.

Moreover, it is when the EGR valve is wide open to the maximum that the above conventional EGR device may recirculate the exhaust gases at the maximum flow rate. Therefore, if a required flow rate of recirculation of the exhaust gases corresponding to a driving state in the combustion chamber of the engine exceeds the maximum flow rate, the EGR device is disadvantageously unable to recirculate the exhaust gases in accordance with the required flow rate.

On the other hand, it is conceivable that a so-called internal EGR (internal exhaust gas recirculation) may be used to recirculate exhaust gases. The internal EGR utilizes a variable valve timing control or VTC, and simultaneously opens both of the intake valve and the exhaust valve in the engine, thereby recirculating part of the exhaust gases to the combustion chamber of the engine.

However, the variable valve timing control that determines timing of opening or closing the intake valve and the exhaust valve of the engine may preferably control power generation in the engine so that properties thereof may be adjusted to a best torque condition. This points to the limitations on the use of the variable valve timing control as a means of exhaust gas recirculation flow rate control; thus disadvantageously too much control by the variable valve timing control would preferably be avoided.

SUMMARY OF THE INVENTION

The present invention is created in view of the above-described circumstances, and it is an exemplified object of the present invention to provide a variable valve timing engine capable of detecting any clogging in the EGR passage to eliminate excess and deficiency of a flow rate of recirculation of exhaust gases, thus reducing $NO_x$ emissions. Another exemplified object of the present invention is to provide a variable valve timing engine that may recirculate exhaust gases in accordance with a required flow rate of recirculation of the exhaust gases even if the required flow rate is very large.

In order to achieve the above objects, there is provided a variable valve timing engine according to one exemplified aspect of the present invention comprising: an EGR passage through which exhaust gases are recirculated from an exhaust system to an intake system; a phase angle adjustment means that adjusts a phase angle between an exhaust cam for opening/closing an exhaust valve and an intake cam for opening/closing an intake valve; and a phase angle adjustment control means that controls the phase angle adjustment means in accordance with a flow rate of recirculation of the exhaust gases in the EGR passage.

If carbon once deposited in the EGR passage is exfoliated for some reason, a rate of flow passing through the EGR passage varies. However, the phase angle control means may actuate the intake valve and the exhaust valve to shift the phase angle therebetween in an advanced-angle or retarded-angle direction to increase or decrease the internal recirculation flow rate of the exhaust gases in accordance with the flow rate of recirculation of the exhaust gases in the EGR passage, so that a whole recirculation flow rate of the exhaust gases becomes a flow rate conformable to a driving state of the engine. Accordingly, the EGR flow rate control may be easily optimized in conformity with the driving state of the engine.

According to another aspect of the present invention, there is provided a variable valve timing engine comprising: an EGR passage through which exhaust gases are recirculated from an exhaust system to an intake system; a phase angle adjustment means that adjusts a phase angle between an exhaust cam for opening/closing an exhaust valve and an intake cam for opening/closing an intake valve, and adjusts overlap or time during which both intake and exhaust valves are open; and a phase angle adjustment control means that controls the phase angle adjustment means in accordance with a flow rate of recirculation of the exhaust gases in the EGR passage. In this embodiment, the phase angle adjustment control means restricts an phase angle adjustment amount by the phase angle adjustment means if the overlap based upon the flow rate of recirculation of the exhaust gases in the EGR passage is larger than the overlap based upon a driving state of the engine.

In the above constructions, since the phase angle between the intake cam and the exhaust cam may be adjusted so as to shift in an advanced-angle or retarded-angle direction in accordance with the flow rate of recirculation of the exhaust gases, the flow rate of recirculation of the exhaust gases as a whole becomes a flow rate conforming to a driving state of the engine, and thus the EGR flow rate control may be optimized easily in accordance with the driving state.

Further, if the overlap of the intake valve and the exhaust valve based upon the flow rate of recirculation of the exhaust gases in the EGR passage is larger than the overlap of the intake valve and the exhaust valve based upon a driving state of the engine, the above phase angle adjustment control means may restrict the phase angle adjustment amount, and the driving state of the engine may be prevented from getting worse.

According to yet another aspect of the present invention, the variable valve timing engine as configured as above may further comprise a clogging detection means that detects a clogging condition in the EGR passage, and the phase angle adjustment control means is configured to control the phase angle adjustment means in accordance with the clogging condition in the EGR passage.

As unburned fuel (hydrocarbon) in exhaust gases deposited on surfaces of the EGR passage and EGR valve were gradually becoming carbonized with intense heat, the EGR passage or an opening/closing portion of the EGR valve would be clogged, or blocked. However, the phase angle adjustment control means may actuate the phase angle adjustment means in response to the clogging, and adjust the flow rate of internal recirculation of the exhaust gases, so that the flow rate of recirculation of the exhaust gases as a whole may be a flow rate conforming to a driving state of the engine.

Further, according to yet another aspect of the present invention, the above clogging detection means may be configured to detect the clogging condition in the EGR passage during a fuel cutoff time.

In this construction, the clogging in the EGR passage may be accurately detected without making emission of the engine worse.

According to yet another aspect of the present invention, a variable valve timing engine as configured above further comprises: an EGR control means that controls an opening of an EGR control valve provided in the EGR passage; a valve timing adjustment means that adjusts opening/closing timing of the intake valve and the exhaust valve; and a valve timing control means that controls the valve timing adjustment means. In this aspect, the EGR control means and the valve timing control means are configured to control the EGR control valve and the valve timing adjustment means respectively in accordance with a required flow rate of recirculation of the exhaust gases.

According to the above embodiment, while the EGR is controlled in accordance with the requested flow rate of recirculation of the exhaust gases, the valve timing is controlled at the same time as appropriate. Therefore, even if the maximum flow rate provided when the EGR control valve is opened wide at the maximum is not more than the required flow rate of recirculation of the exhaust gases, the more flow rate of recirculation of the exhaust gases may be satisfactorily achieved as required with the internal EGR flow rate increased by the valve timing control.

Preferably, control by the EGR control means has a higher priority than control by the valve timing control means. In this embodiment, the flow rate of recirculation of the exhaust gases may be controlled without too much control by the valve timing control; thus, an influence on properties of power generation in the engine may be reduced.

As described above, it is not desirable to use the variable valve timing control as a means of exhaust gas recirculation flow rate control. In this respect, the valve timing control means may control the valve timing adjustment means after the EGR control means exercises control to make the opening of the EGR control valve to a maximum thereof. In this embodiment, the flow rate of recirculation of the exhaust gases is under control of the EGR control means to meet the required flow rate of recirculation until the EGR control valve is opened wide to the maximum, while when the EGR control valve is controlled to open to the maximum, and the flow rate goes beyond control of the EGR control means, the valve timing control means controls the flow rate of recirculation of the exhaust gases. Accordingly, the use of the valve timing control to achieve a desired flow rate of recirculation of the exhaust gases may be minimized, and thus the variable valve timing control may control power generation in the engine, for example, so that properties thereof may be adjusted to a best torque condition.

According to yet another aspect of the present invention, the above valve timing control means may control the valve timing adjustment means when the required flow rate of recirculation of the exhaust gases is within a non-sensitive range of the EGR control valve.

The EGR control valve used in the control of the exhaust gas recirculation cannot be open with a very small opening when the closed EGR control valve is going to open, thus requiring a moderately larger opening. Accordingly, if a required flow rate of recirculation of the exhaust gases is very small, the EGR control valve cannot be satisfactorily controlled. In contrast, the valve timing control means may control even a very small flow rate of recirculation of the exhaust gases. In this respect, the above embodiment is configured to allow the valve timing control means to have control of a very small flow rate within a non-sensitive range of the EGR control valve to satisfy a required flow rate with recirculation of the exhaust gases by the internal EGR. Consequently, even if a required flow rate of recirculation of the exhaust gases is very small, the exhaust gases may be recirculated at a flow rate satisfactory for the required flow rate to the combustion chamber of the engine.

Other objects and further features of the present invention will become readily apparent from the following description of preferred embodiments with reference to accompanying drawings.

DETAILED DESCRIPTION OF THE PREFERRED EMBODIMENTS

One embodiment of the present invention will be described with reference to FIGS. 1 through 10.

Figure 1:
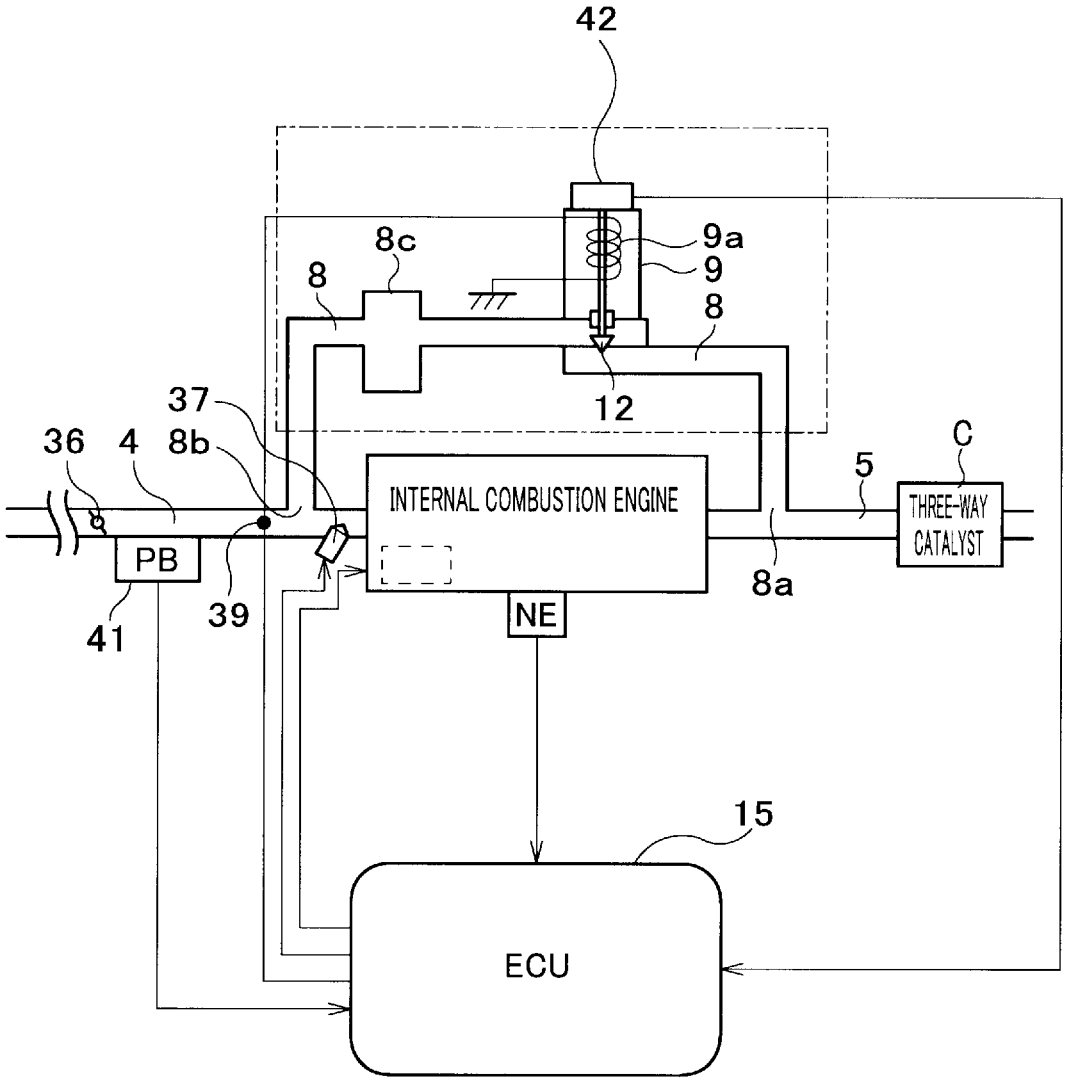
FIG. 1 is a system configuration chart of a four-stroke-cycle engine including an EGR passage and a variable valve timing control (VTC) as a phase angle adjustment means according to a variable valve timing engine as one embodiment of the present invention.
Figure 2:
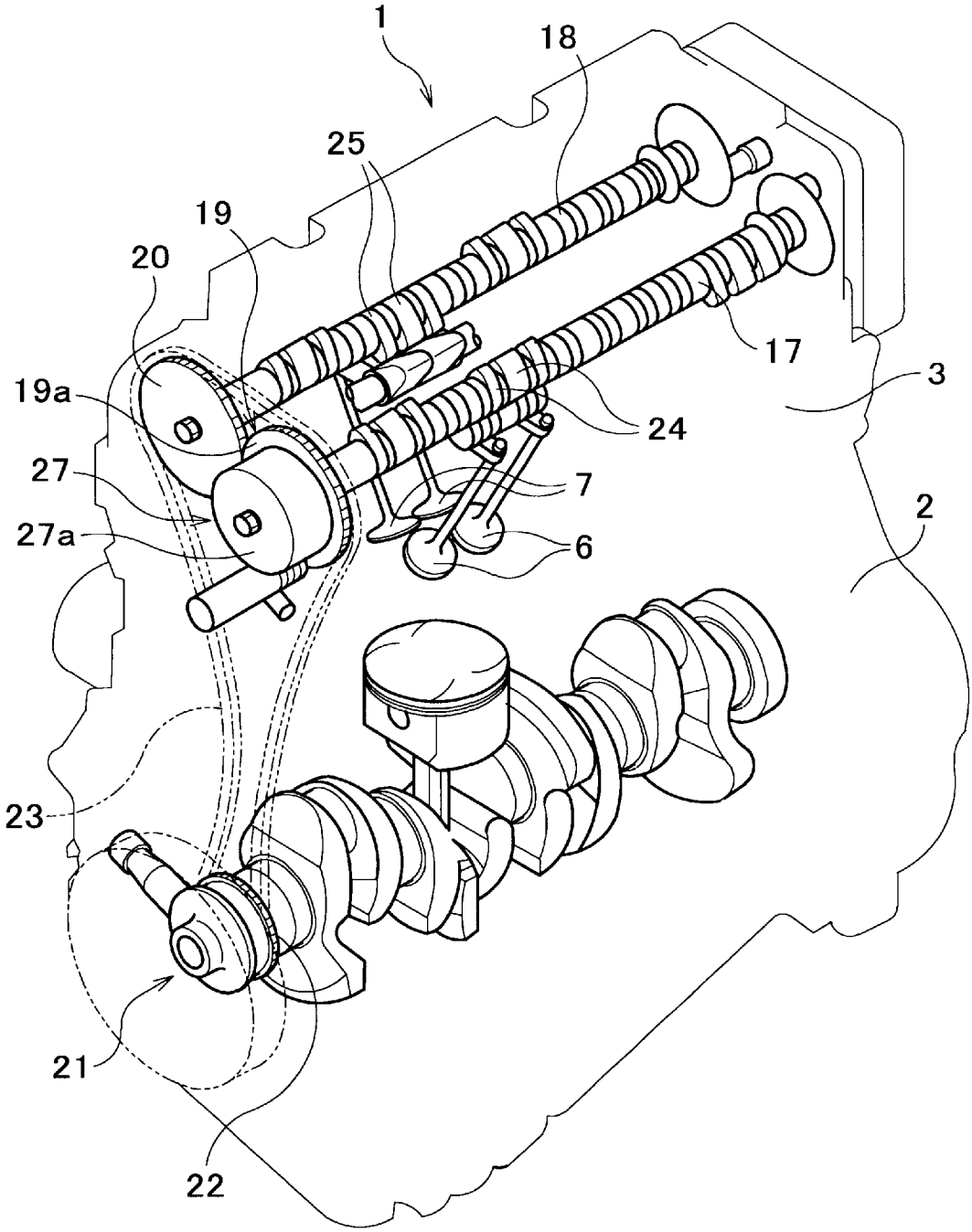
FIG. 2 is a schematic illustration of a drive system and a valve system of a variable valve timing engine according to the present invention.

FIG. 1 depicts a four-stroke-cycle engine system according to the present invention; FIG. 2 depicts structures of a drive system and valve system of the same engine.

In these drawings, denoted by 1 is an engine, denoted by 2 is a cylinder block, denoted by 3 is a cylinder head, denoted by 4 is an intake pipe (including an intake port) that defines an intake passage, and denoted by 5 is an exhaust pipe (including an exhaust port) that defines an exhaust passage.

To the intake port in the engine 1, an intake valve 6 is attached in an openable/closable manner; to the exhaust port, an exhaust valve 7 is attached in an openable/closable manner. The above intake pipe 4 and the above exhaust pipe 5 are connected with each other via an EGR passage 8 provided to recirculate exhaust gases. At a junction of the EGR passage 8 and the exhaust pipe 5, more specifically, at an EGR port 12 is provided an EGR valve 9 serving to adjust a flow rate of recirculation of the exhaust gases.

The above EGR valve 9 may be electrically powered or negative-pressure-actuated. A solenoid-controlled valve is used in the present embodiment.

The EGR passage 8 is connected at one end 8*a* thereof to an upstream end of a three-way catalyst C of the exhaust pipe 5, and at the other end 8*b* thereof to a downstream end of a throttle valve 36 of the intake pipe 4. The EGR valve 9 and a positive-displacement chamber 8*c* for controlling a flow rate of recirculation of exhaust gases are interposed in the EGR passage 8.

The EGR valve 9 is made of a solenoid valve actuated by a solenoid 9*a*, which is connected with an ECU 15, and a valve opening of the EGR valve 9 is configured to vary linearly according to a control signal from the ECU 15. In the EGR valve 9 is provided a lift sensor 42 for detecting a valve opening of the EGR valve 9, and a detection signal from the lift sensor 42 is configured to be output to the ECU 15.

The ECU 15 makes a determination of a driving state of the engine based upon engine parameter signals and the like from a variety of sensors that will be described later, and outputs a control signal to the solenoid 9*a* so that a valve opening instruction value of the EGR valve 9 configured according to an absolute pressure PB in the intake pipe 4 and an engine rpm NE, and an actual valve opening of the EGR valve detected by the lift sensor 42 may be set within the same variation.

As shown in FIG. 2 in detail, on the cylinder head 3 are rotatably supported an intake camshaft 17 and an exhaust camshaft 18. Driven sprockets 19, 20 of the both camshafts 17, 18, and a driving sprocket 22 of a crankshaft 21 are connected with each other via an endless timing chain 23. The both camshafts 17, 18 are driven to make one revolution per two revolutions of the crankshaft 21.

The above intake camshaft 17 is integrally formed with an intake cam 24 for opening and closing the intake valves 6, 6, while the above exhaust camshaft 18 is integrally formed with an exhaust cam 25 for opening and closing the exhaust valves 7, 7.

In addition, at one end of the intake camshaft 17 is provided a phase angle adjustment means (hereinafter referred to as "VTC") 27 that allows the intake camshaft 17 to relatively turn with respect to the driven sprocket 19, and thereby allows the phase angle of the intake cam 24 to change with respect to the crankshaft 21.

Figure 3:
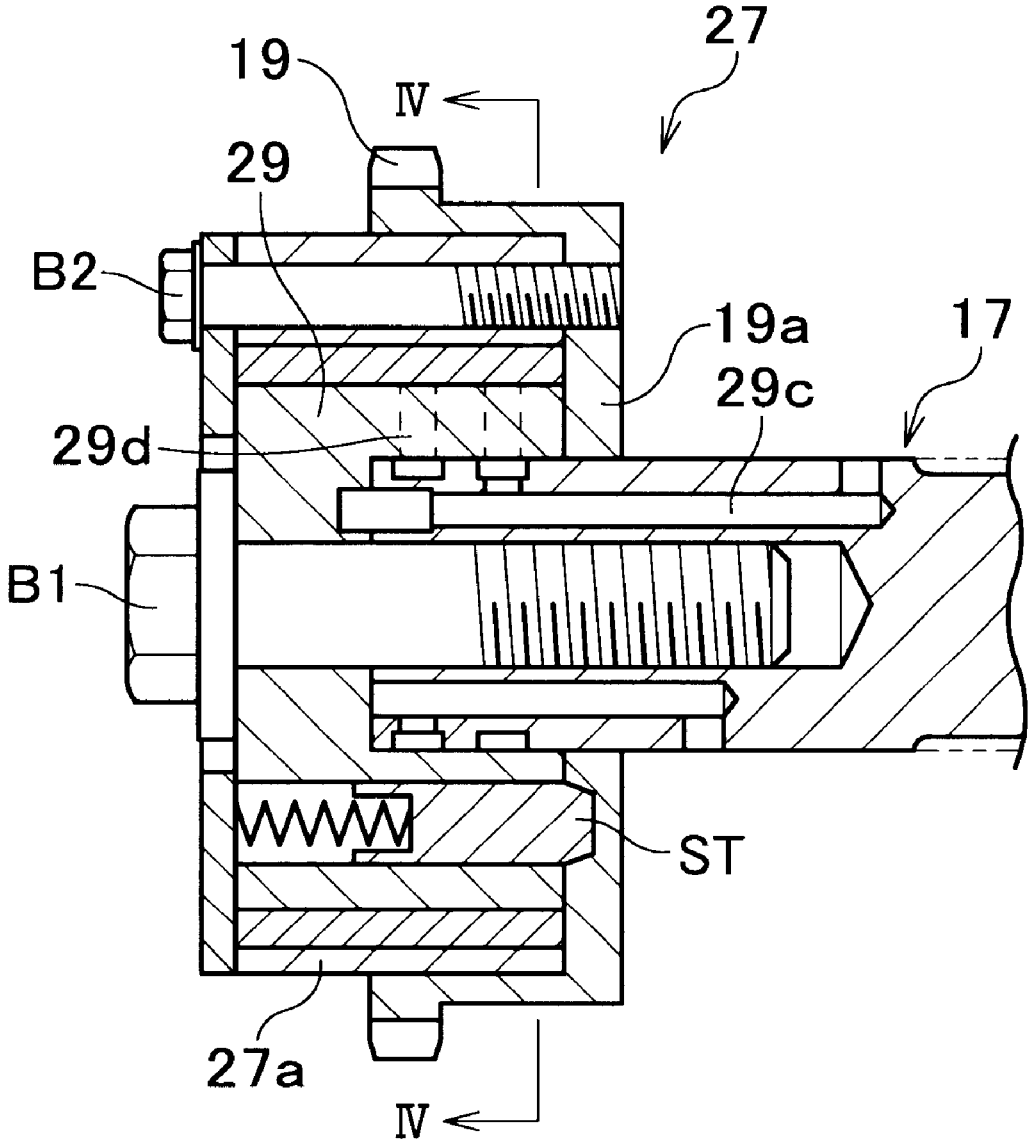
FIG. 3 is a cross-sectional view of an internal structure of a variable valve timing control according to the present invention with a principal part illustrated in detail.
Figure 4:
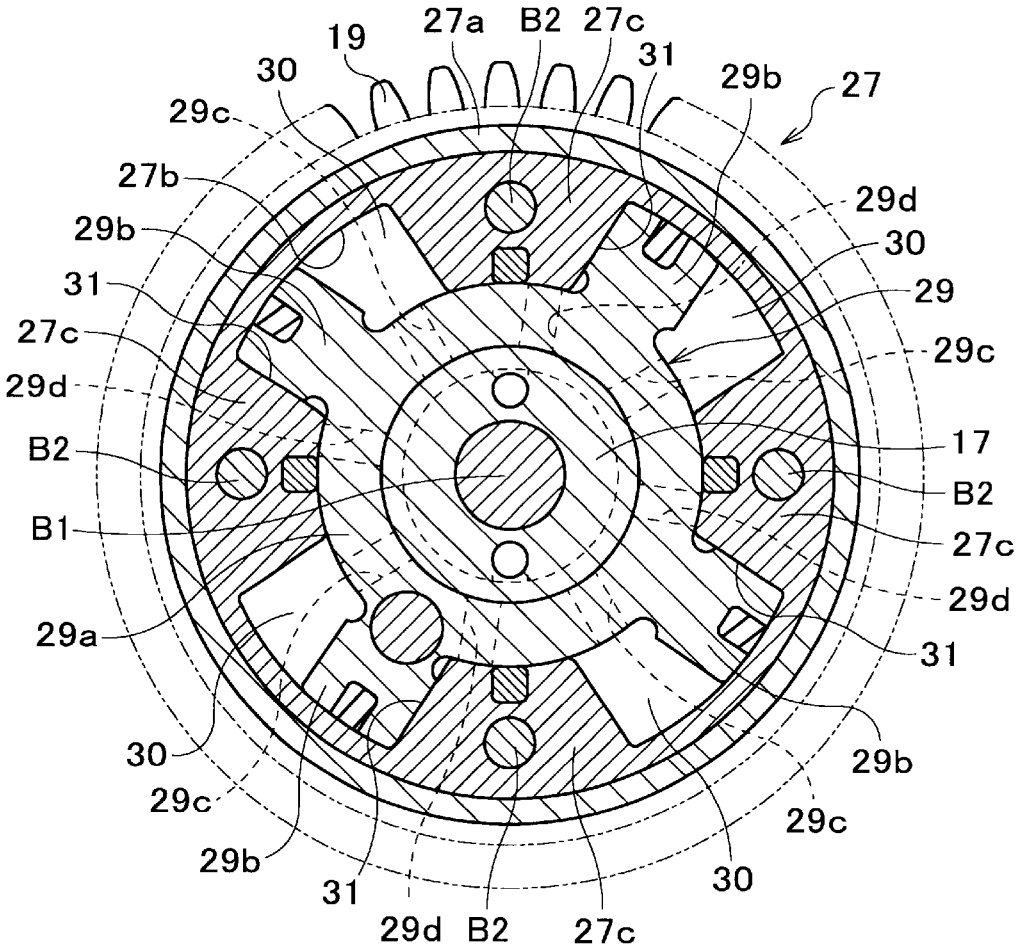
FIG. 4 is a cross-sectional view of the variable valve timing control according to the present invention, taken along a line IV—IV in FIG. 3.
Figure 5:
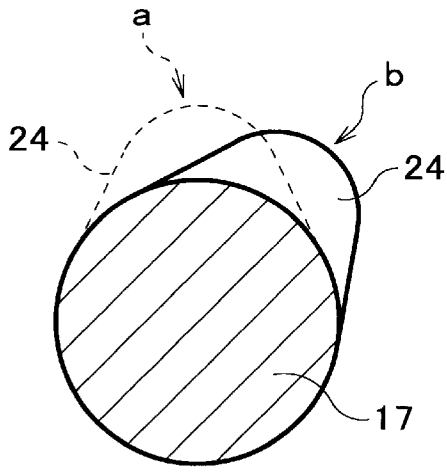
FIG. 5 is a schematic illustration for indicating an adjusted state of a phase angle of an intake camshaft according to the present invention.

FIG. 3 shows an internal structure of the VTC 27; FIG. 4 shows a cross-section thereof taken along a line IV—IV in FIG. 3. As shown in FIGS. 3 and 4, a vane (rotor) 29 for adjusting a phase angle of the intake camshaft 17 is included in a housing 27*a*. The housing 27*a* is fastened on the driven sprocket 19 with a bolt B1, and the vane 29 is fastened on the one end of the intake camshaft 17 with a bolt B2.

As shown in FIG. 4, a plurality of vane portions 29*b* are formed on a boss portions 29*a* so as to project outwardly from a peripheral surface. On an inner wall 27*b* of the housing 27*a* are formed partition walls 27*c* that divide an inner space of the housing 27*a* in a direction along a periphery thereof to form a plurality of hydraulic pressure chambers. Hydraulic fluid passages for turning the vane 29 with a direction of the turn of the vane 29 switched between advanced-angle and retarded-angle directions are each formed through the vane portions 29*b* in the intake camshaft 17 and the boss portion 29*a* of the vane 29.

One of the hydraulic fluid passages serves as an advanced-angle hydraulic fluid passage 29*c* for turning the vane 29 in the advanced-angle direction, and the other of the hydraulic fluid passages serves as an retarded-angle hydraulic fluid passage 29*d* for turning the vane 29 in the retarded-angle direction, each connected to an oil pump (not shown) through a hydraulic pressure control valve 28 that will be described later.

When hydraulic fluid is supplied to a hydraulic fluid chamber 30 at an advanced-angle side of the vane 29 (hereinafter referred to as "advanced-angle chamber 30"), while hydraulic fluid in equivalent quantities is discharged from a hydraulic fluid chamber 31 at a retarded-angle side of the vane 29 (hereinafter referred to as "retarded-angle chamber 31"), the intake camshaft 17 is turned in the advanced-angle direction within a range of the adjacent partition walls 27*c*, 27*c*. Conversely, when hydraulic fluid is supplied to the retarded-angle chamber 31, while hydraulic fluid in equivalent quantities is discharged from the advanced-angle chamber 30, the intake camshaft 17 is turned in the retarded-angle direction within a range of the adjacent partition walls 27*c*, 27*c*. Accordingly, the intake cam 24 may be advanced from a retarded-angle position as indicated by a dotted line a in FIG. 5 to an advanced-angle position as indicated by a dotted line b in FIG. 5, and may be retarded from the advanced-angle position to the retarded-angle position.

In FIG. 3, a sign ST designates a stopper for restricting a turn of the vane 29. The stopper ST is released by pressure of the hydraulic fluid supplied through the hydraulic fluid passage (not shown).

Figure 6:
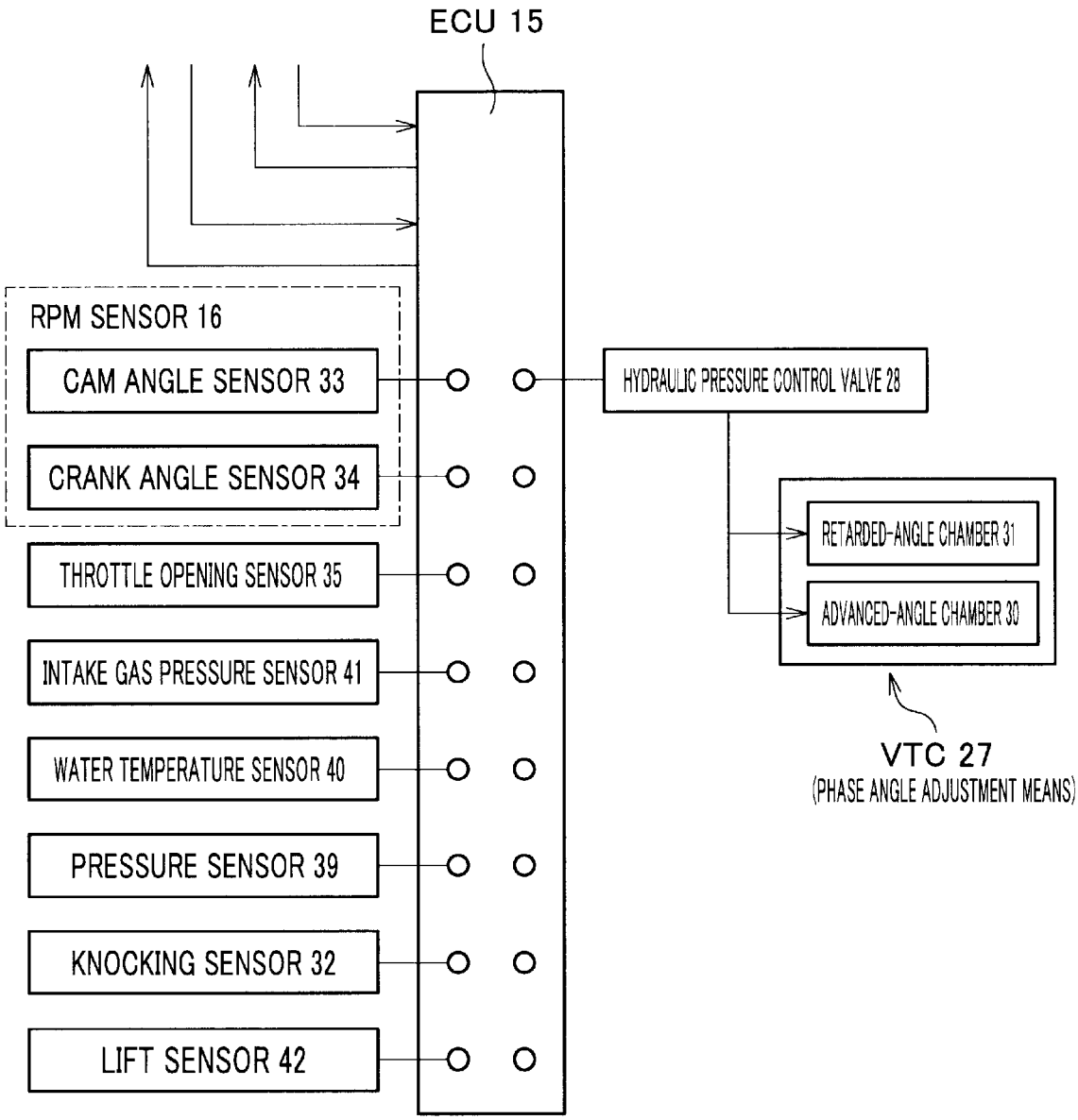
FIG. 6 is a block diagram for indicating a control system and a detection system according to the present invention.

FIG. 6 shows sensors of various kinds for detecting a driving state of the engine, and the above-described hydraulic pressure control valve 28, as well as the ECU 15. The hydraulic pressure control valve 28 is comprised of a linear solenoid valve including a driving coil (not shown), a spool (not shown) driven by the driving coil, and the like, and serves to change a position of the spool in accordance with an output duty ratio (output control value) of electric current supplied from the ECU 15 to the driving coil.

The hydraulic pressure control valve 28 is configured to shift the spool from a neutral position to one side so as to open the advanced-angle chamber 30 if an output duty ratio (output control value) output from the ECU 15 is larger than a holding duty ratio (e.g., 50%), and to shift the spool from the neutral position to the other side so as to open the retarded-angle chamber 31 if the output duty ratio is smaller than the holding duty ratio.

Figure 7:
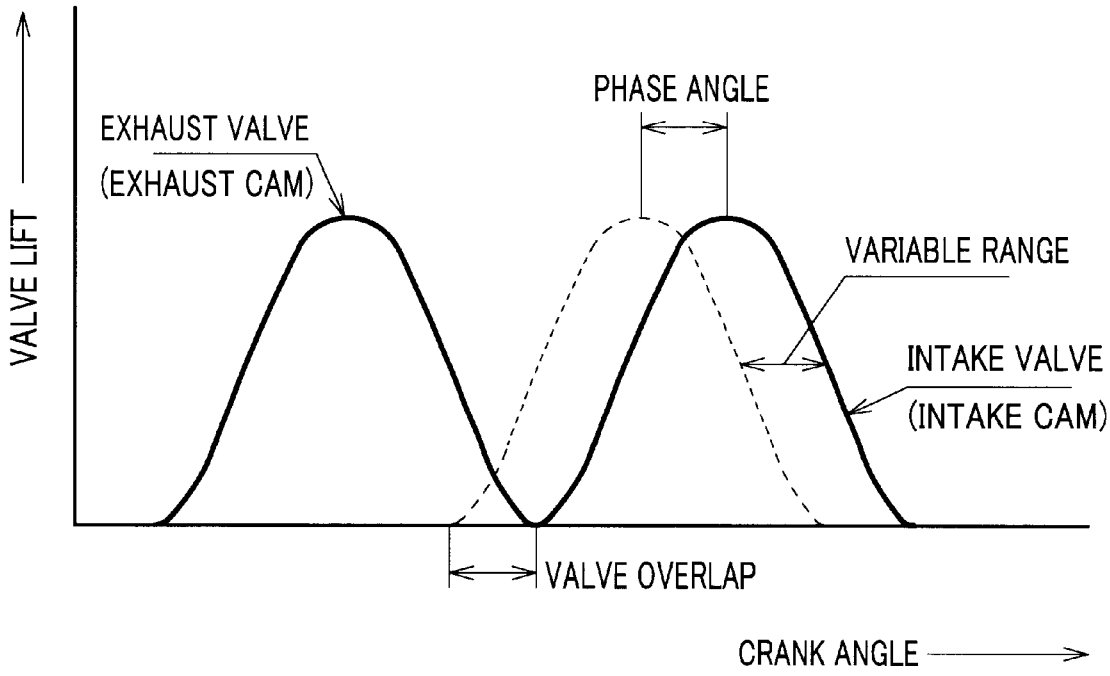
FIG. 7 is a diagram for indicating valve timing, phase angles, and valve lift states of an intake valve and an exhaust valve of a variable valve timing engine according to the present invention.

Therefore, if the output duty ratio (output control value) is larger than the holding duty ratio (e.g., 50%), the intake camshaft 17 is turned to the advanced-angle side by pressure of the hydraulic fluid supplied to the advanced-angle chamber 30, and the phase angle of the intake cam 24 relative to the exhaust cam 25 is advanced as shown in FIG. 7. On the other hand, if the output duty ratio (output control value) is smaller than the holding duty ratio (e.g., 50%), the intake camshaft 17 is turned to the retarded-angle side by pressure of the hydraulic fluid supplied to the retarded-angle chamber 31, and the phase angle of the intake cam 24 relative to the exhaust cam 25 is retarded.

If the output duty ratio is equal to the holding duty ratio, the spool is shifted to the neutral position, and the both of the advanced-angle chamber 30 and the retarded-angle chamber 31 are closed so that supply of the hydraulic fluid to the advanced-angle chamber 30 and the retarded-angle chamber 31 is cut off. Thus, the intake camshaft 17 and the driven sprocket 19 are integrally driven, and the phase angle of the intake cam 24 is kept at a last controlled phase angle.

The ECU 15, a control means as shown in FIG. 6, is comprised of a microcomputer principally including an I/O (Input/Output) device, a CPU or MPU, a RAM, and a ROM (non thereof is shown), and provided with an electric current detection circuit (not shown) for detecting an actual electric current value flowing through a driving coil of the hydraulic pressure control valve 28, an A/D converter for converting analog signals transmitted from the sensors of various kinds to a digital form, and a wave shaping device for shaping a waveform.

To the ECU 15 are connected a knocking sensor 32, a cam angle sensor 33 for detecting a cam angle, a crank angle sensor 34 for detecting a crank angle, a throttle opening sensor 35 for detecting a throttle opening, a pressure sensor 39 for detecting a clog in the EGR passage 8, a water temperature sensor 40 for detecting temperature of cooling water, an intake gas pressure sensor 41 for detecting an amount of gas sucked, a $CO_2$ sensor (not shown) for detecting an air-fuel ratio (A/F), a lift sensor (EGR valve opening sensor) 42 for detecting a valve lift of the EGR valve 9, and the like. The cam angle sensor 33 and the crank angle sensor 34 may be used to determine an engine rpm, and thus called an engine rpm sensor 16 herein.

The cam angle sensor 33 serves to detect a phase angle of the intake cam 24, and is, for example, comprised of a magnet sensor and an MRE pickup (magnetic pickup), thereby outputting a cam pulse to the ECU 15 per predetermined crank angle (e.g., 180 degrees) in accordance with rotation of the intake camshaft 17. The crank angle sensor 34 is comprised as the cam angle sensor 33, and thereby outputs a crank pulse to the ECU 15 per predetermined crank angle (e.g., 30 degrees) in accordance with rotation of the crank shaft 21. The crank angle sensor 34 detects a ratchet as a reference, and outputs a reference pulse to the ECU 15 once every time the crank shaft 21 makes one turn, while the water temperature sensor 40 detects water temperature of cooling water circulating through a radiator (not shown) and a water jacket (not shown) in the engine 1, and outputs the water temperature to the ECU 15. The throttle opening sensor 35 detects a throttle opening of the throttle valve 36, and the intake gas sensor 41 detects an absolute pressure in the intake pipe; each sensor outputs the detected values to the ECU 15.

The ECU 15 employs the engine rpm sensor 16 to obtain an engine rpm NE. To be more specific, the ECU 15 calculates a phase angle of the intake cam 24 out of a crank pulse output from the crank angle sensor 34 and a cam pulse output from the cam angle sensor 33, and obtains an engine rpm NE from a crank pulse, and an intake gas amount from an intake gas pressure, thereby exercises control so as to make the driving state of the engine 1 better.

For example, fuel injection time (injected fuel amount) of an injector 37 (see FIG. 1) is controlled based upon an engine rpm, an engine load, an intake gas amount, and ignition timing is corrected based upon a signal from the knocking sensor 32. When a driving state gets into a surge area, based upon the corrected ignition timing, the hydraulic fluid control valve 28 is controlled to supply hydraulic fluid to the retarded-angle chamber 31, thus shifting the phase angle of the intake valve 6 in a retarded-angle direction.

When exhaust gases are recirculated, the ECU 15 determines an optimal flow rate of recirculation of the exhaust gases for a driving state using a map (not shown) optimized in accordance with various parameters such as a load, rpm, cooling water temperature, etc. of the engine 1, corresponding to the driving state of the engine 1. The ECU 15 then controls the solenoid 9*a* so that a lift value detected by the lift sensor 42 may be adjusted to a lift value obtained by looking up the map based upon the optimal flow rate of recirculation of the exhaust gases, and thus controls the opening of the EGR valve 9. At the same time, the ECU 15 uses a clogging detection means to detect clogging in the EGR passage 8 and the EGR port 12, and controls the VTC 27 in accordance with a detected clogging condition.

In the present embodiment, a pressure sensor 39 that is provided downstream from the throttle valve 36 to detect pressure in the intake pipe 4 is used as the clogging detection means. The ECU 15 opens the EGR valve 9 during a fuel cutoff time when the throttle valve 36 is tightly closed, and determines a clogging condition in the EGR passage 8 from variation of values detected through the pressure sensor 39.

Figure 8:
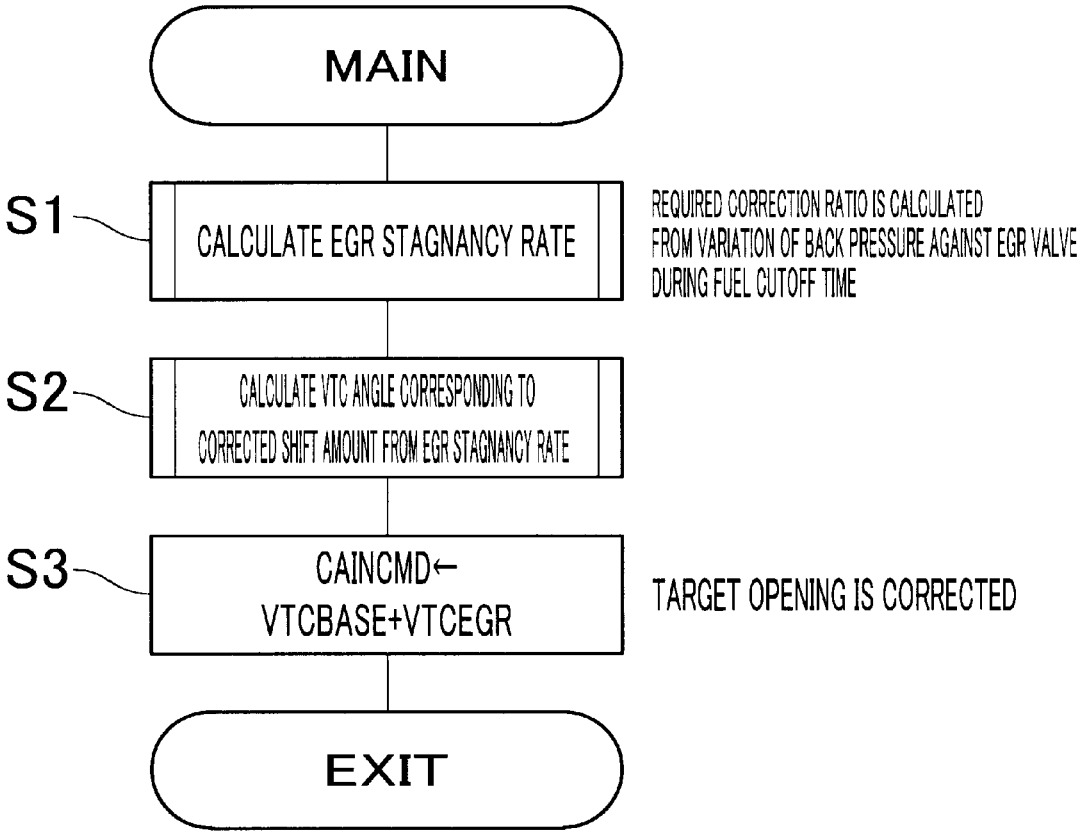
FIG. 8 is a flowchart showing a process of an exhaust gas recirculation control according to the present invention.

FIG. 8 shows a determination routine for clogging in the EGR port 12 and the EGR passage 8.

As shown in FIG. 8, first, an EGR stagnancy rate, i.e., clogging level, is calculated (S1). To be more specific, a pressure variation PB in the intake pipe 4 is obtained based upon a pressure signal output from the pressure sensor 39. Further, the EGR valve 9 is opened during a fuel cutoff time when the throttle valve 36 (see FIG. 1) is tightly closed, to obtain a variation of values detected through the pressure sensor 39. Accordingly, it is determined that a less variation indicates a higher clogging level of the EGR passage 8, and that no variation indicates completely blocked condition of the EGR passage 8.

Figure 9:
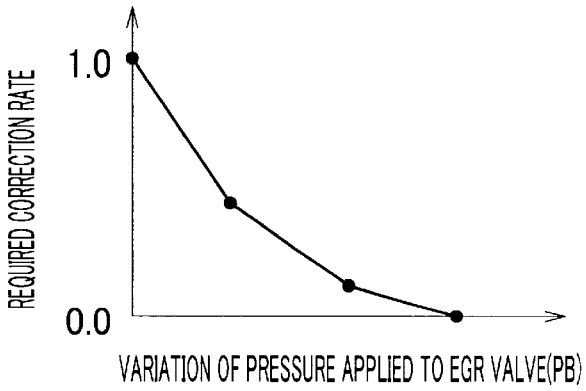
FIG. 9 is a graph showing a correction map based upon correction requirement ratios of exhaust gas recirculation flow rates in relation to pressure variations in the EGR passage according to the present invention.

When a clog in the EGR port 12 or the EGR passage 8 is detected, a correction map as shown in FIG. 9 is looked up by a pressure variation PB, to obtain a required correction ratio of the exhaust gas recirculation flow rate for the clog in the EGR port 12 or the EGR passage 8. The required correction ratio represents the EGR stagnancy rate, i.e., clogging level; more specifically, the required correction ratio of 1.0 indicates that the EGR passage 8 is completely blocked.

As described above, the present embodiment is designed to obtain a pressure variation by opening the EGR valve 9 during a fuel cutoff time, and thus may keep combustion stable when a clogging condition in the EGR passage 8 is determined, while preventing emissions of the engine from deteriorating. Moreover, since the pressure variation is small enough when the throttle valve 36 is tightly closed, the clogging condition in the EGR passage 8 may be accurately detected.

Figure 10:
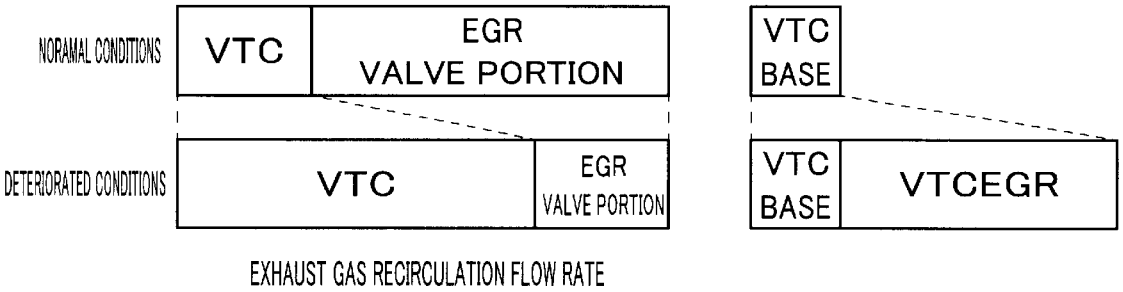
FIG. 10 is a component bar chart for showing a ratio between an exhaust gas recirculation flow rate in an EGR passage and an internal exhaust gas recirculation flow rate adjusted by a phase angle adjustment means, and a ratio between a phase angle of an intake cam based upon a driving state of an engine and the internal exhaust gas recirculation rate adjusted by the phase angle adjustment means, each ratio being calculated based upon values under normal conditions and under deteriorated conditions in recirculation of exhaust gases of a variable valve timing engine according to the present invention.

Next, based upon the EGR stagnancy rate, a VTC angle corresponding to the EGR stagnancy rate, i.e., a shift amount VTCEGR of a corrected phase angle of the intake cam 24 with respect to the exhaust cam 25 is calculated (S2), and VTCBASE+VTCEGR is worked out to obtain a target phase angle CAINCMD of the intake cam 24 (S3), so that an output duty ratio of the hydraulic pressure control valve 28 is determined (see FIG. 10). Accordingly, the phase angle of the intake cam 24 with respect to the exhaust cam 25 is advanced in accordance with a shortage of the exhaust gas recirculation flow, and overlap is changed, so that the shortage of the exhaust gas recirculation flow due to clogging of the EGR port 12 may be overcome.

When carbon deposited in the EGR passage 8 or the EGR port 12 are exfoliated for some reason, and it is determined that the clog becomes extinguished or diminished, as well, a VTC angle corresponding to the EGR stagnancy rate, i.e., a shift amount VTCEGR of a corrected phase angle of the intake cam 24 with respect to the exhaust cam 25 is calculated (S2), and VTCBASE+VTCEGR is worked out to obtain a target phase angle CAINCMD of the intake cam 24 (S3), so that an output duty ratio of the hydraulic pressure control valve 28 is determined (see FIG. 10). Accordingly, the phase angle of the intake cam 24 with respect to the exhaust cam 25 is retarded in accordance with an increase of the exhaust gas recirculation flow, and overlap is changed, so that the exhaust recirculation flow rate may be adjusted.

The ECU 15 prevents a driving state of the engine from deteriorating by restricting the phase angle variation by the VTC 27 to a predetermined phase angle, if the target phase angle CAINCMD exceeds an optimal phase angle for optimizing the driving state of the engine 1. To be more specific, in such circumstances, the ECU 15 may not make a 100% correction of the phase angle, but make a 50% correction of the phase angle, to the target phase angle CAINCMD, so that the driving state of the engine 1 may be kept good. Hereupon, the predetermined phase angle is so small a phase angle including 0% with respect to the target phase angle as to serve to prevent the driving state of the engine 1 from becoming worse.

In controlling operation, if the exhaust gas recirculation flow rate in the EGR passage 8 is restored for some reason, or if the clog is removed as a result of maintenance, the recirculation of exhaust gases by the VTC 27 (internal EGR) is prohibited, and the recirculation of the exhaust gases through the EGR passage 8 (external EGR) is performed. In this situation, a normal control operation is performed by the VTC 27.

A description will be given of a control process according to the present embodiment with reference to FIG. 11.

Figure 11:
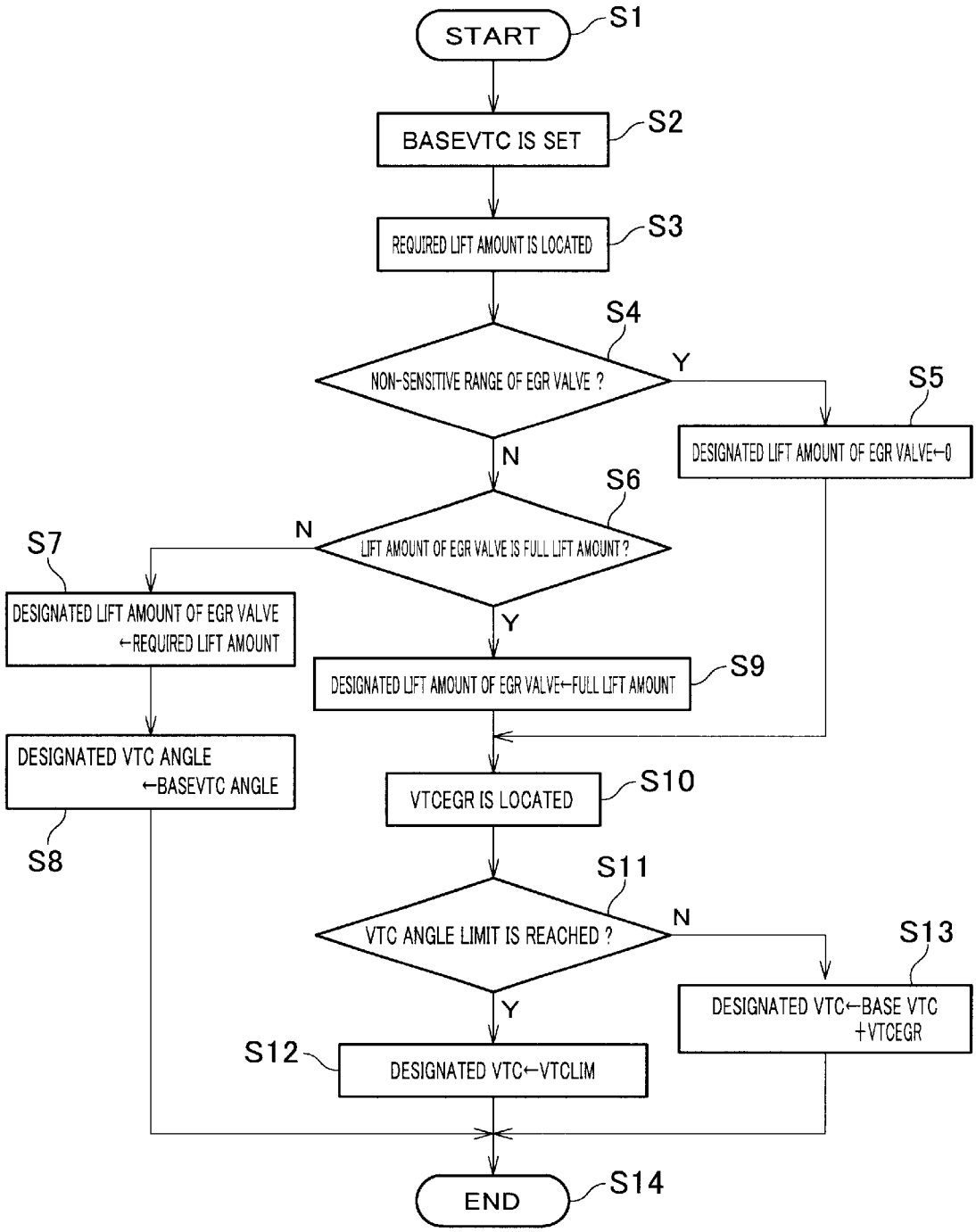
FIG. 11 is a flowchart showing a control process according to the present invention.

FIG. 11 is a flowchart showing a control process performed in the present embodiment.

When a control operation is initiated (S1), a reference advanced angle in the VTC 27 (hereinafter referred to as "BASEVTC angle") is calculated (S2). In order to calculate the BASEVTC angle, an engine rpm is detected using the engine rpm sensor 16. From the detected engine rpm NE, for example, a VTC angle capable of achieving a best torque condition may be located by looking up a map. In general, the advanced angle becomes smaller during idle time or time driven at low rpm, while the advanced angle becomes larger during time driven at high rpm. Increase in the advanced angle advances the phase angle of the intake cam 24 with respect to the exhaust cam 25, as shown in FIG. 7. Consequently, the advanced angle may be set so that a best torque condition for the speed may be achieved.

When the reference advanced angle is calculated, a required flow rate of recirculation of exhaust gases to be partly returned to the combustion chamber of the engine 1 is calculated. The required flow rate of recirculation of the exhaust gases may be obtained from a map (not shown) optimized in accordance with various parameters such as a load, rpm, cooling water temperature, etc. of the engine 1, corresponding to the driving state of the engine 1. The map stores flow rates of recirculation of exhaust gases corresponding to various parameters that may have the effect of reducing $NO_x$ emissions with respect to engine loads, and may thus improve fuel efficiency.

When the required flow rate of recirculation of the exhaust gases is calculated, a required lift amount of the EGR valve 9 corresponding to the required flow rate of recirculation of the exhaust gases is located from a map (S3). The lift amount that is located is a value required when all the exhaust gases corresponding the required flow rate of recirculation of the exhaust gases are recirculated through the EGR valve 9 back to the combustion chamber. As described above, control of the EGR valve 9 is given a higher priority than control by the valve timing control in order to respond to the required flow rate of recirculation of the exhaust gases. Accordingly, the flow rate of recirculation of the exhaust gases may be controlled without too much control by the valve timing control; thus, an influence on properties of power generation in the engine may be reduced.

Subsequently, it is determined whether the required lift amount that has been located is within a non-sensitive range (S4). The closed EGR valve 9 cannot control a small lift amount, and cannot open without a sufficiently larger lift amount. Therefore, if the required flow rate of recirculation of the exhaust gases is very small within a non-sensitive range, the EGR valve 9 is not opened, and VTC 27 advances the phase angle. As the VTC 27 advances the phase angle, overlap between the intake valve and the exhaust valve as shown in FIG. 7 is generated, allowing a small amount of exhaust gases are recirculated to the combustion chamber of the engine. In this manner, control by the valve timing control may be exercised even over a very small amount of flows. Therefore, if the required flow rate of recirculation of the exhaust gases is so small as to fall within a non-sensitive range of the EGR control valve, control by the valve timing control is exercised to satisfy the required flow rate of recirculation with the recirculation of the exhaust gases controlled by means of the internal EGR. Consequently, the present embodiment allows exhaust gases according to the required flow rate to be recirculated to the combustion chamber of the engine even when the required flow rate of recirculation is very small, thus achieving the effect of the EGR.

Accordingly, if the required lift amount of the EGR valve 9 is within a non-sensitive range, the lift amount of the EGR valve 9 is set to zero (S5), and the process goes to step S10 that will be described later. On the other hand, if the required lift amount of the EGR valve 9 is not within the non-sensitive range, then it is determined whether the required lift amount of the EGR valve 9 is a full lift amount (S6). The full lift amount of the EGR valve 9 is determined in advance in accordance with performance of the EGR valve 9, or the like.

If the required lift amount is not the predetermined full lift amount, mere an operation of opening the EGR valve 9 allows exhaust gases in an amount corresponding to the required flow rate of recirculation to return to the combustion chamber of the engine, and thus the lift amount of the EGR valve 9 is set to the required lift amount that has been located (S7). Then, the VTC angle is set to the BESEVTC angle (S8). As described above, the flow rate of recirculation of the exhaust gases is controlled by changing the opening of the EGR valve 9 until the EGR valve 9 is opened wide to the maximum, and when the EGR valve 9 is opened to the maximum, and the flow rate goes beyond permissible control range thereof, the valve timing control exercises control over the flow rate of recirculation of the exhaust gases. Accordingly, the use of the valve timing control to achieve a desired flow rate of recirculation of the exhaust gases may be minimized, and thus the variable valve timing control may control power generation in the engine, for example, so that properties thereof may be adjusted to a best torque condition.

On the other hand, if the required lift amount is beyond the full lift amount of the EGR valve 9, only the recirculation of the exhaust gases through the EGR valve 9 could not meet the required flow rate of recirculation. Accordingly, if the required lift amount is beyond the full lift amount of the EGR valve 9, i.e., when the opening of the EGR valve 9 reaches the maximum, the EGR valve 9 is configured to shift to a full lift position (S9). In addition, a shortfall of the required flow rate of recirculation that cannot be made up even with the EGR valve 9 in the full lift position may be covered by the VTC 27. Thus, an advanced angle of the VTC 27 corresponding to the shortfall of the required flow rate of recirculation that cannot be made up even with the EGR valve 9 in the full lift position (the advanced angle is hereinafter referred to as "VTCEGR") is located by looking up a map. This search of the VTCEGR is conducted after step S5, as well.

The VTCEGR obtained as described above is added to the BASEVTC, and thus exhaust gases in a specific flow rate corresponding to the required flow rate of recirculation may be recirculated to the combustion chamber. Consequently, even if the EGR valve 9 is opened wide to the maximum but cannot provide exhaust gases at the required flow rate of recirculation, the flow rate of the internal EGR may be increased via the valve timing control, so that much more requirement of recirculation of the exhaust gases may be fulfilled.

However, the VTC angle is predetermined as a value for the best torque condition; therefore, there is not much merit in fulfilling the required flow rate of recirculation by increasing the variation of the VTC angle. Accordingly, a predetermined limit value (hereinafter referred to as "VTCLIM") may be added to the VTC angle. The VTCLIM defines a permissible range out of the value for the best torque condition, and may be set as appropriate.

Next, it is determined whether a value obtained by adding the VTCEGR that has been located to the BASEVTC reaches the VTCLIM (S11). As a result, if the value reaches the VTCLIM, the VTC angle is set to the limit value VTCLIM (S12). On the other hand, if the value does not reach the VTCLIM, a designated value of the VTC angle may be obtained by adding the VTCEGR to the BASEVTC (S13).

As described above, the lift amount of the EGR valve 9 and the VTC angle of the VTC 27 are set, and signals for each value are transmitted to the EGR valve 9 and the VTC 27 respectively; then, the control process is concluded (S14).

Although the preferred embodiments of the present invention have been described above, the present invention is not limited to the above-described embodiments. For example, an electrically-powered solenoid valve is employed for the EGR valve 9, but a diaphragm-type valve actuated under negative pressure may be used instead.

In the present embodiment, it has been explained that the shortage of the exhaust gas recirculation flow due to clogging in the EGR passage 8 is relieved by advancing the phase angle of the intake cam 24 with respect to the exhaust cam 25 using the VTC 27 (phase angle adjustment means), but any other variable valve timing control mechanism may be employed.

For example, usable mechanisms include a variable valve timing control (VTE) that changes the phase angle of the exhaust valve 7 with respect to the intake valve 6, and a mechanism that changes the phase angle of the intake cam 24 with respect to the exhaust cam 25 using the VTC 27, while switching the intake cam to a high-speed cam or a low-speed cam using a fluid pressure, a solenoid, or the like.

In the present embodiment, "to adjust a phase angle" means to change a phase of the same intake cam 24, as well as to use the intake cam 24 of different lift.

Accordingly, it is conceivable, as described above, that the intake cam 24 is be turned, the phase angle of the exhaust cam 25 with respect to the intake cam 24 is changed (as in VTE), or the phase of the intake cam 24 is changed by changing a cam nose thereof.

In the above description, the pressure sensor 39 is used as a clogging detection means to detect clogging, but a flow meter (not shown) may be provided in at least any one of upstream and downstream sides of the EGR valve 9 to determine a clogging condition based upon variation of flow of exhaust gases flowing through the EGR passage 8. This construction allows a flow rate of recirculation of the exhaust gases to be controlled more accurately.

It is also conceivable that a temperature sensor (not shown) that detects temperature of exhaust gases or the exhaust pipe 5 (exhaust passage) is provided downstream in the EGR passage 8 to determine increase or decrease of the recirculation flow based upon variation of the temperature detected. This construction allows temperature to be detected from the outside of the EGR passage 8.

The control process according to the present embodiment allows the valve timing control means to control the variable valve timing control when the EGR valve is open wide to the maximum, but may allow the valve timing control means to control the variable valve timing control from some time before the EGR valve becomes open wide to the maximum (e.g., when the EGR valve is open half the maximum opening). Even when control is exercised by the valve timing control before the EGR valve becomes open wide to the maximum, control by the EGR control is given higher priority than the control by the valve timing control, and thus the flow rate of recirculation of the exhaust gases may be controlled without too much control by the valve timing control. Consequently, an influence on properties of power generation in the engine may be reduced.

Various modifications and changes may be made in the present invention without departing from the spirit and scope thereof, and it is understood that the present invention covers such modifications or changes.

According to the present invention, the following advantageous effects may be achieved.

Since the phase angle between the exhaust cam and the intake cam is adjusted in accordance with increase or decrease of recirculation flow of exhaust gases passing through the EGR passage (exhaust gas recirculation passage) according to an embodiment, increase in $NO_x$ emissions may be prevented.

Since the phase angle adjustment control means restricts an phase angle adjustment amount if the overlap between the exhaust valve and the intake valve based upon the flow rate of recirculation of the exhaust gases in the EGR passage is larger than the overlap between the exhaust valve and the intake valve based upon a driving state of the engine, the driving state of the engine may be prevented from deteriorating.

Since the phase angle between the exhaust cam and the intake cam is adjusted in accordance with the clogging condition in the EGR passage to accommodate variation of recirculation flow rate of the exhaust gases passing through the EGR passage, $NO_x$ emissions may be reduced.

Since the clogging detection means detects the clogging condition in the EGR passage during fuel cutoff time, clogging may be detected without deteriorating combustion in the engine such as in exhaust gas emissions.

Moreover, according to the embodiment as set forth in which the EGR control means and the valve timing control means are configured to control the EGR control valve and the valve timing adjustment means respectively in accordance with a required flow rate of recirculation of the exhaust gases, even if the EGR valve that has been open wide to the maximum has not fulfilled a required flow rate of recirculation of the exhaust gases, the valve timing control serves to increase the internal EGR flow rate, and may thus meet a requirement for much more flows of recirculation of the exhaust gases.

According to the embodiment as set forth in which control by the EGR control means has a higher priority than control by the valve timing control means, the flow rate of recirculation of the exhaust gases may be controlled without too much control by the valve timing control, and thus an influence on properties of power generation in the engine may be reduced.

According to the embodiment as set forth in which the valve timing control means controls the valve timing adjustment means after the EGR control means exercises control to make the opening of the EGR control valve to a maximum thereof, the valve timing control for accomplishing a desired flow rate of recirculation of the exhaust gases may be avoided to the utmost, and thus properties of power generation in the engine may be adjusted to a best torque condition.

According to the embodiment as set forth in which the valve timing control means controls the valve timing adjustment means when the required flow rate of recirculation of the exhaust gases is within a non-sensitive range of the EGR control valve, even if the required flow rate of recirculation of the exhaust gases is very small, exhaust gases equivalent to the required flow rate of recirculation may be recirculated to the combustion chamber of the engine.

What is claimed is:

1. A variable valve timing engine comprising:

an EGR passage through which exhaust gases are recirculated from an exhaust system to an intake system;

a phase angle adjustment means that adjusts a phase angle between an exhaust cam for opening/closing an exhaust valve and an intake cam for opening/closing an intake valve, and adjusts overlap or time during which both intake and exhaust valves are open; and a phase angle adjustment control means that controls the phase angle adjustment means in accordance with a flow rate of recirculation of the exhaust gases in the EGR passage, wherein the phase angle adjustment control means restricts an phase angle adjustment amount by the phase angle adjustment means if the overlap based upon the flow rate of recirculation of the exhaust gases in the EGR passage is larger than the overlap based upon a driving state of the engine.

2. A variable valve timing engine according to claim 1, further comprising a clogging detection means that detects a clogging condition in the EGR passage, wherein the phase angle adjustment control means is configured to control the phase angle adjustment means in accordance with the clogging condition in the EGR passage.

3. A variable valve timing engine according to claim 2, wherein the clogging detection means is configured to detect the clogging condition in the EGR passage during a fuel cutoff time.

4. A variable valve timing engine comprising:

an EGR passage through which exhaust gases are recirculated from an exhaust system to an intake system;

a phase angle adjustment means that adjusts a phase angle between an exhaust cam for opening/closing an exhaust valve and an intake cam for opening/closing an intake valve; and a phase angle adjustment control means that controls the phase angle adjustment means in accordance with a flow rate of recirculation of the exhaust gases in the EGR passage; further comprising:

an EGR control means that controls an opening of an EGR control valve provided in the EGR passage;

a valve timing adjustment means that adjusts opening/closing timing of the intake valve and the exhaust valve; and a valve timing control means that controls the valve timing adjustment means, wherein the EGR control means and the valve timing control means are configured to control the EGR control valve and the valve timing adjustment means respectively in accordance with a required flow rate of recirculation of the exhaust gases.

5. A variable valve timing engine according to claim 1, further comprising:

an EGR control means that controls an opening of an EGR valve provided in the EGR passage;

a valve timing adjustment means that adjusts opening/closing timing of the intake valve and the exhaust valve; and a valve timing control means that controls the valve timing adjustment means, wherein the EGR control means and the valve timing control means are configured to control the EGR control valve and the valve timing adjustment means respectively in accordance with a required flow rate of recirculation of the exhaust gases.

6. A variable valve timing engine comprising:

an EGR passage through which exhaust gases are recirculated from an exhaust system to an intake system;

a phase angle adjustment means that adjusts a phase angle between an exhaust cam for opening/closing an exhaust valve and an intake cam for opening/closing an intake valve; and a phase angle adjustment control means that controls the phase angle adjustment means in accordance with a flow rate of recirculation of the exhaust gases in the EGR passage; further comprising:

an EGR control means that controls an opening of an EGR control valve provided in the EGR passage;

a valve timing adjustment means that adjusts opening/closing timing of the intake valve and the exhaust valve; and a valve timing control means that controls the valve timing adjustment means, wherein the EGR control means and the valve timing control means are configured to control the EGR control valve and the valve timing adjustment means respectively in accordance with a required flow rate of recirculation of the exhaust gases;

wherein control by the EGR control means has a higher priority than the valve timing control means.

7. A variable valve timing engine according to claim 5, wherein control by the EGR control means has a higher priority than control by the valve timing control means.

8. A variable valve timing engine according to claim 6, wherein the valve timing control means controls the valve timing adjustment means after the EGR control means exercises control to make the opening of the EGR control valve to a maximum thereof.

9. A variable valve timing engine according to claim 7, wherein the valve timing control means controls the valve timing adjustment means after the EGR control means exercises control to make the opening of the EGR control valve to a maximum thereof.

10. A variable valve timing engine comprising:

an EGR passage through which exhaust gases are recirculated from an exhaust system to an intake system;

a phase angle adjustment means that adjusts a phase angle between an exhaust cam for opening/closing an exhaust valve and an intake cam for opening/closing an intake valve; and a phase angle adjustment control means that controls the phase angle adjustment means in accordance with a flow rate of recirculation of the exhaust gases in the EGR passage; further comprising:

an EGR control means that controls an opening of an EGR control valve provided in the EGR passage;

a valve timing adjustment means that adjusts opening/closing timing of the intake valve and the exhaust valve; and a valve timing control means that controls the valve timing adjustment means, wherein the EGR control means and the valve timing control means are configured to control the EGR control valve and the valve timing adjustment means respectively in accordance with a required flow rate of recirculation of the exhaust gases;

wherein the valve timing control means controls the valve timing adjustment means when the required flow rate of recirculation of the exhaust gases is within a non-sensitive range of the EGR control valve.

11. A variable valve timing engine according to claim 5, wherein the valve timing control means controls the valve timing adjustment means when the required flow rate of recirculation of the exhaust gases is within a non-sensitive range of the EGR control valve.

* * * * *